US005198726A

United States Patent [19]

Van Meurs et al.

[11] Patent Number: 5,198,726

[45] Date of Patent: Mar. 30, 1993

[54] ELECTRONIC BALLAST CIRCUIT WITH LAMP DIMMING CONTROL

[75] Inventors: Johannes M. Van Meurs; Jozef H. Reinaerts, both of Eindhoven, Netherlands

[73] Assignee: U.S. Philips Corporation, New York, N.Y.

[21] Appl. No.: 770,059

[22] Filed: Sep. 30, 1991

[30] Foreign Application Priority Data

Oct. 25, 1990 [NL] Netherlands ..... 9002332

[51] Int. Cl.[5] ..... H05B 37/02

[52] U.S. Cl. ..... 315/224; 315/307; 315/291

[58] Field of Search ..... 315/DIG. 7, 291, 307, 315/224, 209 R, 200 R, 208, 205, 194, DIG. 5, DIG. 4

[56] References Cited

U.S. PATENT DOCUMENTS

| | | | |
|---|---|---|---|
| 3,913,002 | 10/1975 | Steigerwald | 315/208 |
| 4,894,587 | 1/1990 | Jungreis | 315/224 |
| 4,906,901 | 3/1990 | Carroll | 315/307 |
| 5,066,894 | 11/1991 | Klier | 315/224 |
| 5,075,602 | 12/1991 | Overgoor | 315/224 |
| 5,097,181 | 3/1992 | Kakitani | 315/224 |
| 5,103,142 | 4/1992 | Daub | 315/224 |

*Primary Examiner*—Eugene R. LaRoche
*Assistant Examiner*—A. Zarabian

[57] ABSTRACT

A circuit arrangement for operating a discharge lamp having a load branch provided with lamp connection terminals and coupled to a branch of a DC-AC converter. The branch of the converter includes at least one switching element for generating and supplying a current of alternating polarity to the load branch by being alternately conductive and non-conductive at a frequency f. A drive circuit makes the switching element alternately conductive and non-conductive at the frequency f. A control circuit is coupled to the drive circuit and to the discharge lamp for generating a control signal which is dependent on the lamp current and serves to influence the frequency. The control signal is also dependent on a signal S which is a measure of comparatively rapid changes in the power consumed by the discharge lamp. The lamp power thus can be adjusted over a wide range irrespective of the type of discharge lamp used.

21 Claims, 3 Drawing Sheets

ELECTRONIC BALLAST CIRCUIT WITH LAMP DIMMING CONTROL

BACKGROUND OF THE INVENTION

This invention relates to a circuit arrangement for operating a discharge lamp, comprising a load branch B provided with lamp connection terminals, a DC-AC converter provided with a branch A coupled to the load branch B and comprising at least one switching element for generating a current of alternating polarity through the load branch B by being alternately conducting and non-conducting at a frequency f, a drive circuit E for rendering the switching element alternatively conducting and non-conducting at the frequency f, a control circuit C coupled to the drive circuit and the discharge lamp for generating a control signal which is dependent on the lamp current and serves to influence the frequency.

Such a circuit arrangement is described in the European Patent Application EPA 0351012.

The circuit arrangement described therein controls the amplitude of the lamp current of a discharge lamp operated by the circuit arrangement at a substantially constant level.

If the control signal is also dependent on the lamp voltage, it is possible to control the average value of the power consumed by the lamp (this average value will be called the lamp power hereinafter) at a substantially constant value for various types of discharge lamps and to render it substantially independent of factors such as variations in the supply voltage or fluctuations in the ambient temperature. If the control signal is dependent on a desired average value of the power consumed by the discharge lamp, there is a possibility of dimming the discharge lamp through adjustment of the desired average value of the power consumed by the discharge lamp. When the setting of the desired average value of the power consumed by the discharge lamp is changed, the value of the frequency f is adapted in such a way that the lamp power is substantially equal to the desired power. This adjustment possibility for the lamp power, however, functions only over a lamp power range within which there is an unequivocal relation between the lamp power and the frequency f. Every value of the frequency f in that case corresponds to one value of the lamp power. Since the load branch B often comprises inductive means connected in series with the lamp, the lamp power decreases with an increase in the frequency f. Such a relation is found over a comparatively wide lamp power range in practice for many discharge lamps of various types and power ratings. This relation renders it possible to adjust the lamp power over a desired range by means of the frequency f.

For some discharge lamps, however, the relation between the frequency f and the lamp power is not unequivocal over a part of a desired adjustment range of the lamp power. As a result, there is also no unequivocal relation between the control signal and the lamp power over this portion of the desired adjustment range of the lamp power. It is found for certain compact fluorescent lamps, for example, that the lamp power increases with an increase in the value of the frequency f over a certain lamp power range, whereas the lamp power decreases with an increasing frequency f for lamp power values outside this range. This means that, within a certain range of the frequency f, every value of the frequency f corresponds to two or more different values of the lamp power. These lamp power values also fail to show an unequivocal relation to the control signal. Lamp power values situated within the range over which the lamp power increases as a function of the frequency cannot be adjusted: an oscillation of the lamp power is found to take place between the desired value and a second value of the lamp power belonging to the relevant value of the frequency f. Besides a relation between lamp power and the frequency f within a certain lamp power range which is not unequivocal, there is also found to exist a relation between the average lamp current and the frequency f within a certain range of the average lamp current which is not unequivocal for such lamps. The result is that some values of the average lamp current cannot be adjusted, while for some settings oscillations in the lamp current amplitude are found to occur.

SUMMARY OF THE INVENTION

The invention has for its object, inter alia, to provide a circuit arrangement with which the lamp power of a discharge lamp operated by means of the circuit arrangement can be adjusted over the desired adjustment range in that, irrespective of the type of discharge lamp, an unequivocal relation exists between the lamp power and the control signal throughout this range.

According to the invention, this object is achieved in that the control signal is, in addition, dependent on a signal S which is a measure of comparatively quick changes in the power consumed by the discharge lamp.

It has been found that an unequivocal relation between the control signal and the lamp power is possible in that the control signal also depends comparatively quick changes in the lamp power.

The signal S may be derived from the lamp current, but also from other parameters such as the lamp voltage or the phase difference between the voltage across and the current through the load branch.

In a preferred embodiment of a circuit arrangement according to the invention, the signal S is generated through rectification of a signal voltage which is proportional to the instantaneous value of the lamp current, and from which the DC component and high-frequency components are subsequently substantially eliminated by means of filters. The signal S obtained in this way is an AC voltage. It has been found that the use of this signal S renders the lamp power adjustable over a wide range, also at a low ambient temperature. In a further preferred embodiment of a circuit arrangement according to the invention, the control circuit is provided with means for superimposing two signals. The generation of a control signal which is dependent on the lamp current as well as on the signal S can be realised in a simple manner in that the signal S is superimposed on a signal which is dependent on the lamp current.

BRIEF DESCRIPTION OF DRAWINGS

Embodiments of a circuit arrangement according to the invention will be described in greater detail with reference to the accompanying drawing.

In the drawing.

DESCRIPTION OF THE PREFERRED EMBODIMENTS

Figure 1:
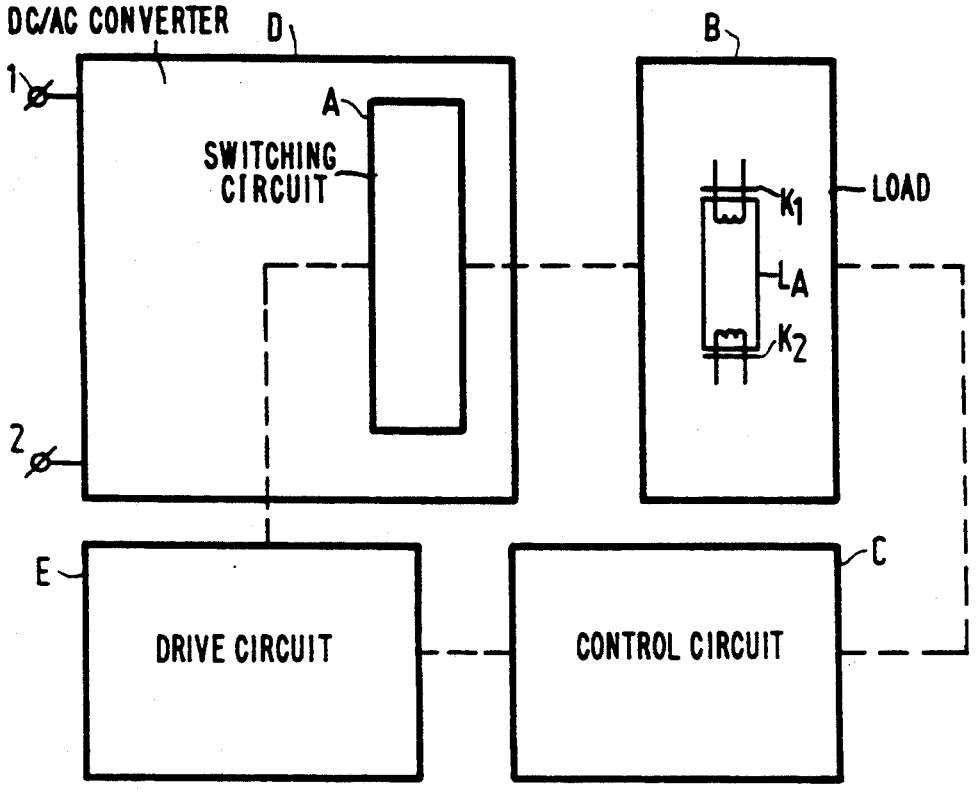
FIG. 1 is a diagrammatic representation of the build-up of a circuit arrangement according to the invention.

In FIG. 1, the couplings between various portions of the circuit arrangement are indicated with broken lines.

B is a load branch provided with lamp connection terminals K1 and K2. A lamp La can be connected to the lamp connection terminal K1 and K2. D is a DC-AC converter provided with input terminals 1 and 2 and with a branch A which comprises at least one switching element for generating a current of alternating polarity through the load branch B by being alternately conducting and non-conducting at a frequency f. Branch A is for this purpose coupled to load branch B. E is a drive circuit coupled to branch A for rendering the switching element in branch A alternately conducting and non-conducting at the frequency f. C is a control circuit for generating a control signal which is to influence the frequency f, which control signal is dependent on the lamp current as well as on a signal S which is a measure of comparatively quick changes in the power consumed by the discharge lamp. Control circuit C is for this purpose coupled to load branch B and drive circuit E.

The operation of the circuit arrangement shown in FIG. 1 is as follows. When input terminals 1 and 2 are connected to poles of a DC-voltage source, the drive circuit E renders the switching element in branch A alternately conducting and non-conducting at a frequency f. As a result, a current whose polarity changes at the frequency f flows through the load branch B. The control circuit generates a control signal which is to influence the frequency f and which is dependent on the lamp current as well as on a signal S which is a measure of comparatively quick changes in the power consumed by the discharge lamp. Since the control signal is also dependent on the signal S, there is an unequivocal relation between the control signal and the lamp power over substantially the entire range of this lamp power, irrespective of the type and power rating of the discharge lamp La. This renders it possible to set the lamp power for any desired value.

Figure 2:
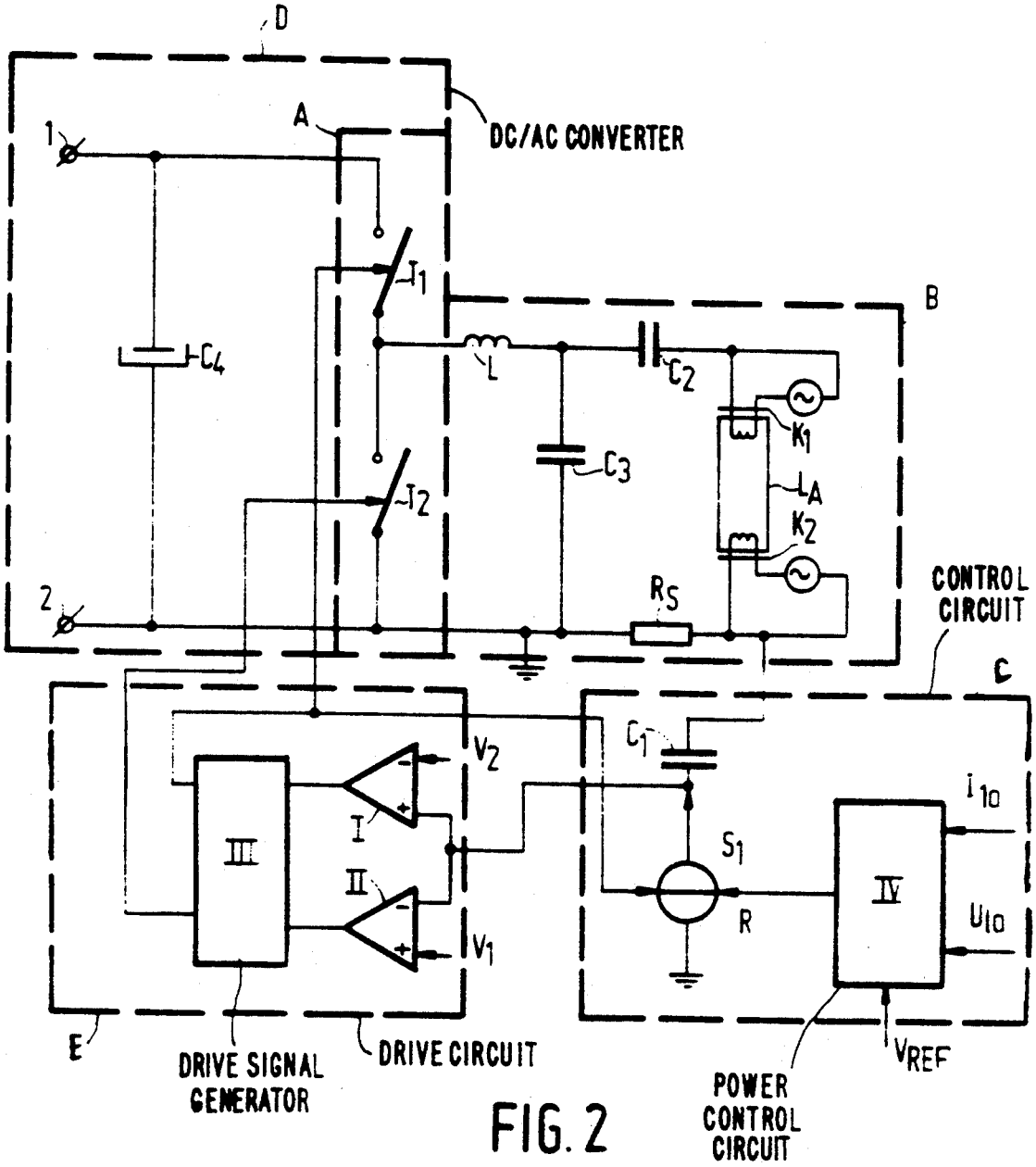
FIG. 2 shows in greater detail the embodiment represented in FIG. 1.

In FIG. 2, branch A is formed by a series circuit of switching elements T1 and T2. Branch A together with input terminals 1 and 2 and capacitor C4 forms a DC-AC converter. Coil L, capacitors C2 and C3, lamp connection terminals K1 and K2, and sensor resistor Rs constitute load branch B. A discharge lamp La can be connected to the lamp connection terminals. Comparators I and II and circuit element III constitute drive signal generator E. Control circuit C in this embodiment consists of current source S1, capacitor C1 and circuit element IV.

The circuit arrangement is built up as follows.

A first end of branch A is connected to input terminal 1 and a further end of branch A is connected to input terminal 2. Input terminal 2 is also grounded. Input terminals 1 and 2 are interconnected by capacitor C4. Switching element T2 of branch A is shunted by a series circuit of coil L and capacitor C3. Capacitor C3 is shunted by a series circuit of capacitor C2, lamp connection terminal K1, lamp connection terminal K2 and sensor resistor Rs. Circuit element IV is coupled to the lamp in a manner not shown in the Figure. If the input terminals 1 and 2 are connected to the poles of a DC-voltage source and the switching arrangement is in stationary operation, different signals, which are a measure f the lamp current and the lamp voltage, respectively, are present at corresponding inputs of the circuit section IV by means of the coupling to the lamp. A voltage Vref is present at a further input, which voltage is a measure of a desired lamp power value. An output of the circuit section IV is connected to current source S1. A signal R present at this output is dependent on the lamp power as well as on the desired lamp power. The strength of a current supplied by the current source depends on the signal R. The current source is connected to a first side of capacitor C1, which is charged and discharged in turn by the current source. A further side of the capacitor C1 is connected to a side of the sensor resistor Rs remote from input terminal 2. Since the lamp current flows through Rs, the voltage across Rs is proportional to the instantaneous value of the lamp current: the voltage across Rs in this embodiment forms the signal S. The potential at the first side of the capacitor C1 is equal to the sum of the voltage across the resistor Rs and the voltage across the capacitor C1, and in this embodiment acts as the control signal. The first side of capacitor C1 is connected to an input of a first comparator and an input of a further comparator. A substantially constant voltage V1 is present at a further input of the first comparator. A substantially constant voltage V2 is present at a further input of the further comparator. Voltage V2 is higher than voltage V1. An output of the first comparator is connected to an input of circuit element III. An output of the further comparator is connected to a further input of circuit element III. A first output of circuit element III is connected to an input of the current source. It is realised in this way that the current generated by the current source reverses its direction when the control signal is lower than the potential V1 or higher than the potential V2. As a result, the control signal is a substantially triangular voltage. The first output of circuit element III is also coupled to the switching element T1. A further output of circuit element III is coupled to switching element T2. In a stationary operating condition, the drive circuit E renders the switching elements alternately conducting at a frequency f. As a result, a substantially square-wave voltage at the frequency f is present between ends of the load branch, and a current flows through the load branch whose polarity changes with frequency f. The frequency f is substantially equal to the frequency of the control signal. The frequency of the control signal depends on the potential Vref which is a measure of the desired lamp power, and also depends on the actual lamp power. If the control signal were to be exclusively dependent on the desired and the actual lamp powers, the relation between the control signal and the lamp power would not be unequivocal over a certain lamp power range for some lamps, for example, compact fluorescent lamps. As a result, an oscillation of the actual lamp power occurs in some settings of the desired lamp power by means of such a control signal. Owing to the contribution of the voltage across Rs, however, the control signal is also dependent on comparatively quick changes in the lamp power, so that the relation between the control signal and the lamp power is unequivocal over the entire desired adjustment range of the lamp power, and substantially all desired lamp powers can be realised without oscillations occurring, irrespective of the type of discharge lamp used. Since only the resistor Rs is required for generating the signal S in this embodiment, the means for generating the signal S in this embodiment are simple and inexpensive.

Figure 3:
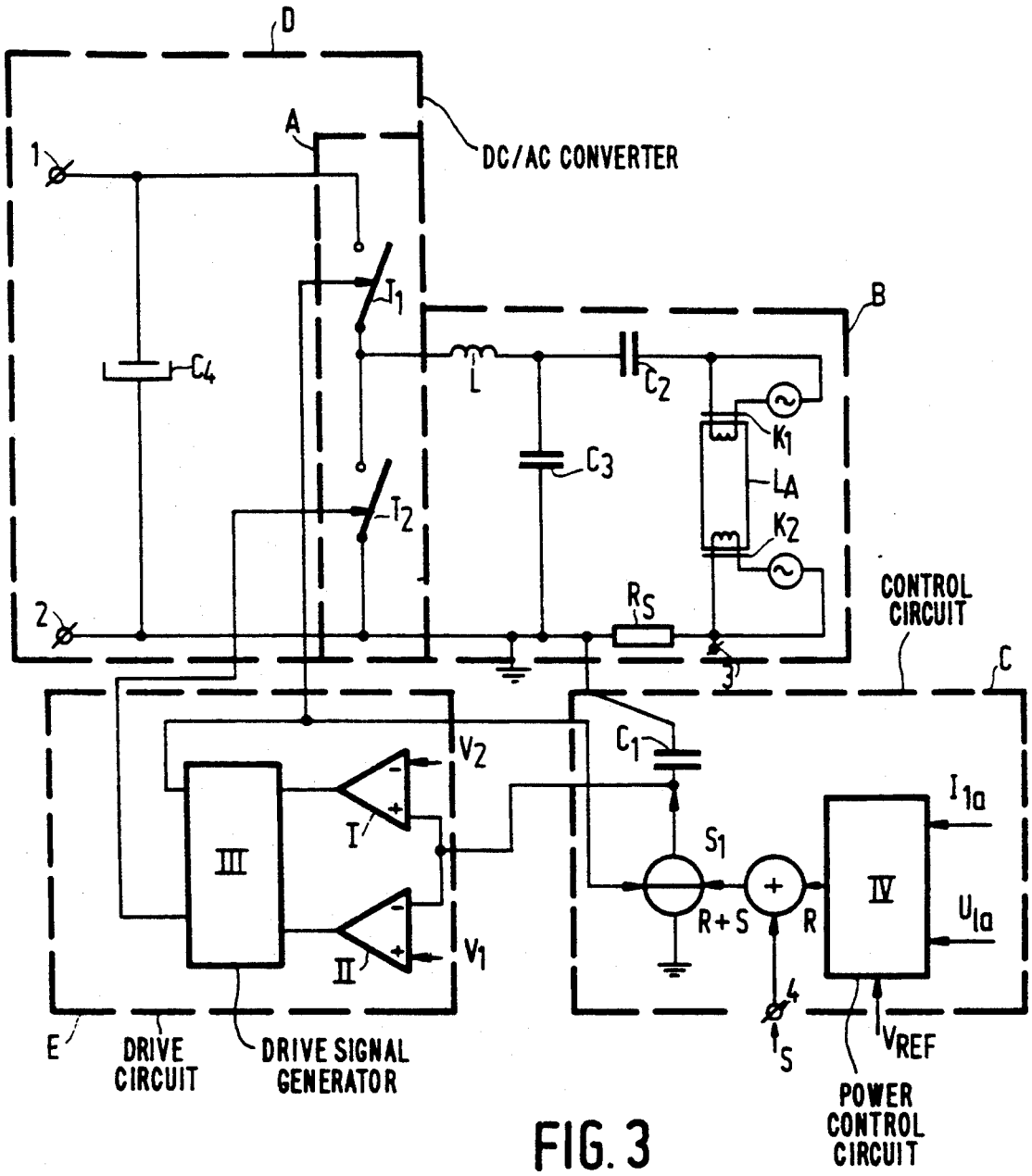
FIG. 3 gives a further detailed view of the embodiment represented in FIG. 1, and FIGS. 4a–4c show the build-up of an embodiment of a circuit section for generating a signal S from the lamp current, as well as the shape of a voltage present at an input and the shape of a voltage present at an output of the circuit section.

The circuit arrangement shown in FIG. 3 is for a major part identical to the circuit arrangement shown in FIG. 1. However, the further side of capacitor C1 in the circuit arrangement shown in FIG. 3 is grounded, while moreover an adder device is present between the output of circuit element IV and current source S1 for increasing the signal R by a signal S which is a measure of comparatively quick changes in the lamp power. The control signal in this embodiment is the substantially triangular voltage across capacitor C1, and the frequency f is substantially equal to the frequency of the control signal. Since the strength of the current supplied by the current source also depends on signal S, the control signal is equally dependent on the signal S. For this embodiment of a circuit arrangement according to the invention, too, an unequivocal relation between the control signal and the lamp power is found over the entire desired adjustment range of the lamp power, irrespective of the type of discharge lamp used.

Figure 4A:
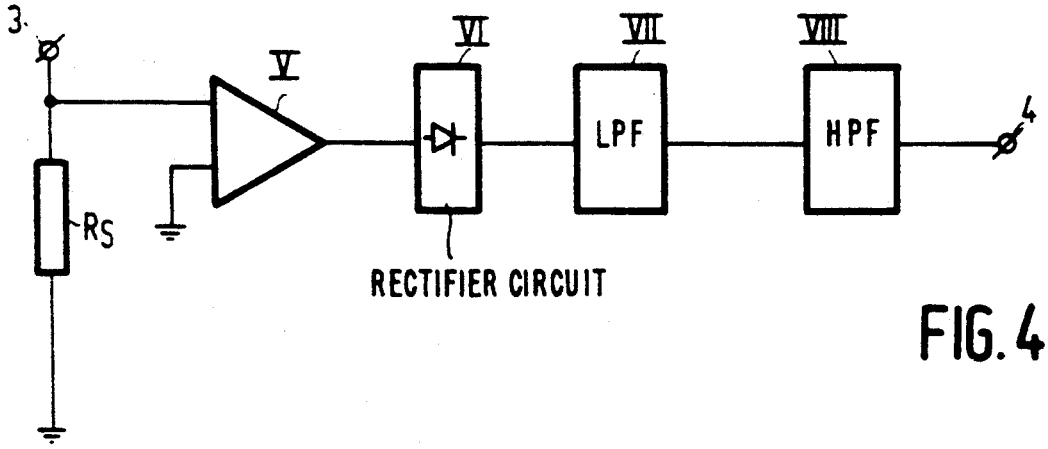
Figure 4B:
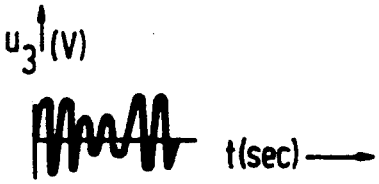
Figure 4C:
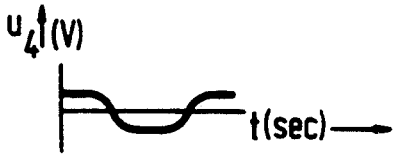

In FIG. 4*a*, resistor Rs conducts the lamp current during the operation of the circuit section, while one end of the resistor Rs is grounded. As a result, a voltage U3 is present at input terminal 3, which is connected to a further end of the resistor Rs, which voltage U3 is proportional to the instantaneous value of the lamp current. This voltage is shown as a function of time in FIG. 4*b*. Input terminal 3 is connected to an input of an amplifier V for amplifying this voltage. An output of this amplifier is connected to an input of rectifier means VI for rectifying the amplified voltage. An output of the rectifier means is connected to an input of a low-pass filter VII. A signal is present at an output of low-pass filter VII which is proportional to the amplitude of the lamp current. The output of low-pass filter VII is connected to an input of high-pass filter VIII. A signal U4 is present at an output 4 of high-pass filter VIII which is substantially equal to the AC component of the signal present at the output of low-pass filter VII. This signal U4 is highly suitable for acting as the signal S a in the embodiment of a circuit arrangement according to the invention as shown in FIG. 3. The signal U4 is shown as a function of time in FIG. 4*c*. An important advantage of this shape of the signal S used in the embodiment shown in FIG. 3 is that the power of the lamp La is adjustable over a wide range also at comparatively low ambient temperature, irrespective of the type of the discharge lamp.

It was found to be impossible to adjust the lamp power for values between approximately 10% and 25% of the rated power for a compact fluorescent lamp having a rated power of 24 W by means of a circuit arrangement as described in the opening paragraph, in which the control signal does not also depend on comparatively quick changes in the power consumed by the lamp. By means of a practical embodiment based on the example as shown in FIG. 2 or in FIG. 3, however, it was found to be possible to adjust lamp powers also in this range.

We claim:

1. A circuit arrangement for operating a discharge lamp, comprising:

a load branch provided with lamp connection terminals, a DC-AC converter comprising a branch coupled to the load branch and including at least one switching element for deriving a current of alternating polarity through the load branch by being alternately conducting and non-conducting at a frequency f, a drive circuit for making the switching element alternately conducting and non-conducting at the frequency f, and a control circuit coupled to the drive circuit and the discharge lamp for generating a control signal which is dependent on the lamp current and serves to influence the frequency, characterized in that the control signal is also dependent on a signal S which is a measure of comparatively quick changes in the power consumed by the discharge lamp.

2. A circuit arrangement as claimed in claim 1, wherein the signal S is generated by a means for detecting the instantaneous lamp current.

3. A circuit arrangement as claimed in claim 2, wherein the control circuit comprises rectifier means and filters for generating the signal S.

4. A circuit arrangement as claimed in claim 1, further comprising means for deriving a further signal dependent on the lamp current and wherein the control circuit comprises means for superimposing the signal S on the further signal.

5. A circuit arrangement as claimed in claim 2, further comprising means for deriving a further signal dependent on the lamp current and wherein the control circuit comprises means for superimposing the signal S on the further signal.

6. A circuit arrangement as claimed in claim 3, further comprising means for deriving a further signal dependent on the lamp current and wherein the control circuit comprises means for superimposing the signal S on the further signal.

7. A discharge lamp electronic ballast circuit with dimming control, said electronic ballast circuit comprising:

a pair of input terminals for a supply voltage, a load circuit provided with lamp connection terminals, a DC/AC converter coupled to said input terminals and comprising at least one semiconductor switching element for deriving an alternating current for the load circuit at a frequency f, a drive circuit coupled to a control input of the semiconductor switching element for alternately driving the semiconductor switching element into conduction and cut-off at the frequency f, means for deriving a signal S which is a measure of rapid changes in the power consumed by the discharge lamp, a control circuit coupled to the signal deriving means and to the discharge lamp for generating a control signal which is dependent both on an electric parameter related to lamp power and to the signal S, and means for coupling the control signal of the control circuit to an input of the drive circuit so that the control signal controls the frequency f of the semiconductor switching element so as to both stabilize and adjust the lamp power thereby to provide a light dimming control for the discharge lamp.

8. An electronic ballast circuit as claimed in claim 7, further comprising means for supplying to the control circuit a reference signal indicative of desired lamp power, said control circuit further comprising:

means for comparing the reference signal with a further signal derived from the discharge lamp and indicative of the actual lamp power thereby to derive an internal control signal, means for combining said internal control signal with the signal S to generate said control signal dependent on lamp power and on the signal S.

9. An electronic ballast circuit as claimed in claim 7, wherein said electric parameter is lamp current, and wherein said load circuit includes an inductor connected in series with the lamp connection terminals.

10. An electronic ballast circuit as claimed in claim 7, wherein said control circuit includes means for comparing signals indicative of lamp current and lamp voltage with a reference signal indicative of desired lamp power, and a current source controlled at least by an output signal of the comparing means.

11. An electronic ballast circuit as claimed in claim 10, wherein said current source is jointly controlled by the output signal of the comparing means and the signal S.

12. An electronic ballast circuit as claimed in claim 11, wherein the control circuit further comprises a capacitor coupled to an output of the current source and to the input of the drive circuit via said coupling means.

13. An electronic ballast circuit as claimed in claim 10, wherein the control circuit further comprises a capacitor coupled to an output of the current source and to said means for deriving the signal S.

14. An electronic ballast circuit as claimed in claim 7, wherein the DC/AC converter further comprises a second semiconductor switching element also controlled by the drive circuit so as to be alternately conductive and cut-off in push-pull with the one semiconductor switching element.

15. An electronic ballast circuit as claimed in claim 7, wherein the control circuit further comprises a current source coupled to a capacitor for charging and discharging the capacitor as a function of the signal S and said electric parameter, and said drive circuit supplies a feedback signal to said current source which causes the current supplied by the current source to reverse direction in a manner whereby the generated control signal appears at a terminal of the capacitor and comprises a substantially triangular voltage.

16. An electronic ballast circuit as claimed in claim 7, wherein said signal deriving means is controlled by the lamp current so that the signal S is proportional to lamp current.

17. An electronic ballast circuit as claimed in claim 16, wherein the control circuit includes means for comparing a signal indicative of actual lamp power with a reference signal indicative of desired lamp power, a current source and a capacitor coupled thereto for generating said control signal, said current source being controlled by an output signal of the comparing means and the signal S, and wherein the DC/AC converter further comprises a second semiconductor switching element also controlled by the drive circuit so as to be alternately conductive and cut-off in phase opposition to the one semiconductor switching element.

18. An electronic ballast circuit as claimed in claim 7, wherein said control circuit includes means for comparing a signal indicative of actual lamp power with a reference signal indicative of desired lamp power, wherein the DC/AC converter further comprises a second semiconductor switching element also controlled by the drive circuit so as to be alternately conductive and cut-off in phase opposition to the one semiconductor switching element, and said load circuit includes an inductor connected in series with the lamp connection terminals.

19. An electronic ballast circuit as claimed in claim 18, wherein said pair of input terminals provide a DC supply voltage.

20. An electronic ballast circuit as claimed in claim 7, wherein said control circuit includes means for comparing a signal indicative of actual lamp power with a reference signal indicative of desired lamp power, and said signal S is operable and effective over the entire range of light dimming control of the discharge lamp.

21. An electronic ballast circuit as claimed in claim 7, wherein the signal deriving means comprises:

means for deriving an AC signal proportional to lamp current, a rectifier responsive to the AC signal for deriving a DC voltage proportional to said AC signal, and a low pass filter and a high pass filter connected in cascade between an output of the rectifier and a terminal which supplies the signal S to the control circuit.

* * * * *